US007497165B2

(12) United States Patent
Fujiwara et al.

(10) Patent No.: US 7,497,165 B2
(45) Date of Patent: Mar. 3, 2009

(54) BLASTING METHOD BY CONTROLLING OXYGEN SUPPLY

(75) Inventors: Shuzo Fujiwara, Tsukuba (JP); Takehiro Matsunaga, Tsukuba (JP); Katsuo Kurose, Kobe (JP); Kiyoshi Asahina, Kobe (JP); Kenji Koide, Kobe (JP)

(73) Assignees: National Institute of Advanced Industrial Science and Technology, Ibaraki (JP); Kabushiki Kaisha Kobe Seiko Sho, Hyogo (JP)

( * ) Notice: Subject to any disclaimer, the term of this patent is extended or adjusted under 35 U.S.C. 154(b) by 282 days.

(21) Appl. No.: 10/583,859

(22) PCT Filed: Jan. 20, 2005

(86) PCT No.: PCT/JP2005/000662

§ 371 (c)(1),
(2), (4) Date: Jun. 21, 2006

(87) PCT Pub. No.: WO2005/068932

PCT Pub. Date: Jul. 28, 2005

(65) Prior Publication Data

US 2007/0144637 A1 Jun. 28, 2007

(30) Foreign Application Priority Data

Jan. 20, 2004 (JP) ..... 2004-012048

(51) Int. Cl.
*F42B 3/00* (2006.01)
*F42B 15/34* (2006.01)
*F42B 33/00* (2006.01)

(52) U.S. Cl. ..... 102/301; 102/293; 86/50

(58) Field of Classification Search ..... 102/301, 102/293; 86/50; 149/109.6; 588/202, 203, 588/403
See application file for complete search history.

(56) References Cited

U.S. PATENT DOCUMENTS 4,949,641 A * 8/1990 Sayles ..... 102/293

(Continued)

FOREIGN PATENT DOCUMENTS

EP 1707914 A1 * 10/2006

(Continued)

OTHER PUBLICATIONS

International Search Report of PCT/JP2005/000662 mailed Feb. 22, 2005.

*Primary Examiner*—Bret Hayes
*Assistant Examiner*—Michael D David
(74) *Attorney, Agent, or Firm*—Reed Smith LLP; Juan Carlos A. Marquez, Esq.

(57) ABSTRACT

A blasting method of blasting an explosive device at least containing an explosive and a chemical agent in a sealed pressure vessel that prevents soot generation during blasting and improves an efficiency of decomposing the chemical agent. First, a transported chemical bomb (explosive) 100 is placed and sealed in a blasting chamber (pressure vessel) 10. The blasting chamber 10 is then brought into a reduced-pressure or vacuum state by aspiration of the air therein by using a vacuum pump 13*a* and oxygen is supplied through an injection port 12 into the blasting chamber 10 to a pressure of 15 to 30% of atmospheric pressure. The chemical bomb 100 is then blasted, as it is ignited by an ignition device not shown in the Figure.

12 Claims, 2 Drawing Sheets

U.S. PATENT DOCUMENTS

| | | | | |
|---|---|---|---|---|
| 5,430,228 | A * | 7/1995 | Ciambrone et al. | 588/320 |
| 5,582,119 | A * | 12/1996 | Barkdoll | 110/346 |
| 5,613,453 | A | 3/1997 | Donovan | |
| 5,781,868 | A * | 7/1998 | Miller et al. | 588/318 |
| 5,864,767 | A * | 1/1999 | Drumgoole et al. | 588/313 |
| 6,260,464 | B1 * | 7/2001 | Gorrell et al. | 86/50 |
| 6,470,783 | B2 * | 10/2002 | Ito et al. | 86/50 |
| 7,073,424 | B2 * | 7/2006 | Ferrari et al. | 86/50 |
| 7,331,268 | B1 * | 2/2008 | Pangilinan et al. | 86/50 |
| 2002/0011172 | A1 | 1/2002 | Ito et al. | |
| 2004/0107824 | A1 * | 6/2004 | Ferrari et al. | 86/50 |
| 2007/0151437 | A1 * | 7/2007 | Fujiwara et al. | 86/50 |

FOREIGN PATENT DOCUMENTS

| | | | |
|---|---|---|---|
| EP | 1867946 | A1 * | 12/2007 |
| EP | 1867947 | A1 * | 12/2007 |
| JP | 7-128000 | | 11/1993 |
| JP | 7-208899 | | 1/1994 |
| JP | 2000-193400 | | 12/1998 |
| JP | 2000-266331 | | 3/1999 |
| JP | 2002-039699 | | 7/2000 |
| JP | 2005207623 | A * | 8/2005 |
| WO | WO 2005068932 | A1 * | 7/2005 |
| WO | WO 2006112182 | A1 * | 10/2006 |

* cited by examiner

BLASTING METHOD BY CONTROLLING OXYGEN SUPPLY

TECHNICAL FIELD

The present invention relates to a method of blasting an explosive device and in particular, to a method of blasting an explosive device at least containing an explosive and a chemical agent such as chemical weapon.

BACKGROUND ART

Explosives in explosive devices have been used for general industrial applications, for example as dynamite, and also for military applications such as chemical weapons (e.g., shell, bomb, land and naval mines). Considering the fume after explosion, an oxidizer or the like is added to the explosives such as dynamite for use in general industrial applications to make the oxygen balance thereof positive or to prevent it from becoming drastically too negative. On the other hand, explosives for use in military applications such as chemical weapon have a negative oxygen balance, to make the most of their respective destructive forces. In addition, chemical weapons contain a chemical agent hazardous to the body such as sulfur mustard or lewisite, together with explosives.

A method of decomposing an explosive completely by blasting it in a pretreatment phase has been known as a method of processing a chemical weapon containing an explosive (see Patent Document 1). The blasting method is used for processing chemical weapons that cause significant corrosion and damage and those having a complicated structure that are difficult to disassemble, and blasting is commonly performed while the chemical weapon is enclosed in a pressure vessel. Chemical weapons still containing a chemical agent are blasted by the method.

A method of decomposing an explosive completely by blasting it after the chemical weapon is disassembled and the chemical agent is removed in a pretreatment phase is also known as a method of processing chemical weapons containing explosive (see Patent Document 2). The blasting method is used for processing of a chemical weapon still retaining its original external shape, and the burster unit disassembled from the chemical weapon is blasted as it is enclosed in a pressure vessel. Although most of the chemical agent is removed in disassembling operation, the burster unit still having some solidified chemical agent adhered thereto by aging is blasted by the method.

In the two blasting methods described above, blasting is said to be performed favorably in a tightly sealed pressure vessel under vacuum, for the following reasons:

(1) It is possible to prevent leakage of the chemical agent contained in the chemical weapon to outside, because it is possible to keep the pressure in the pressure vessel lower (negative) than atmospheric pressure before blasting as well as after blasting; and (2) It is possible to reduce adverse effects on environment including the noise and vibration by blasting drastically.

Patent Document 1: Japanese Unexamined Patent Publication No. 7-208899

Patent Document 2: Japanese Unexamined Patent Publication No. 2002-39699

DISCLOSURE OF THE INVENTION

Generally, explosives are used under air atmosphere both in open and closed systems, and thus, a great amount of soot is not generated after explosion, because oxygen is supplied from air, even if the explosive itself has a negative oxygen balance.

However, when a military explosive having a negative oxygen balance such as TNT is exploded by blasting in a pressure vessel that can be evacuated into a substantially vacuum state (hereinafter, referred to as "evacuatable pressure vessel"), a great amount of soot is generated because of insufficient supply of oxygen. On the other hand, the chemical agent filled in the chemical weapon or the chemical agent adhered to the burster unit may not be completely decomposed by blasting. Thus, it is inevitable to generate soot contaminated with the chemical agent, when a chemical weapon is blasted in an evacuatable pressure vessel. Because the soot, extremely fine particles, has a high possibility of clogging the wastewater system when the pressure vessel is cleaned with a decontaminating agent, such a blasting operation raises problems of decontamination by hand (removal of soot contaminated with chemical agent) or frequent maintenance, and hazardous operation in the region contaminated with a chemical agent hazardous to the body. It also demands an extended period of decontamination operation after blasting, causing a problem of restriction on the number of blasting operations a day.

When a military explosive device containing a filled chemical agent such as chemical weapon is exploded by blasting in an evacuatable pressure vessel, it is not possible to supply oxygen in an amount needed for combustion of the explosive or the entire explosive device containing a chemical agent. As a result, the combustion period of the chemical agent during blasting is shortened, resulting in a problem of deterioration in the efficiency of decomposing the chemical agent, because the carbon chain, for example of sulfur mustard, becomes less susceptible to oxidation.

An object of the present invention, which was made in view of the problems above, is to provide a blasting method that can prevent soot generation by blasting and improve the efficiency of decomposing chemical agent.

To overcome the problems above, the blasting method according to the invention is a blasting method of blasting an explosive device at least containing an explosive and a chemical agent in a sealed pressure vessel, comprising blasting the explosive device, while the pressure vessel is kept under reduced pressure or vacuum and the pressure vessel contains such a particular amount of oxygen that the oxygen balance in the pressure vessel becomes positive and the pressure in the pressure vessel after blasting becomes lower than the pressure outside the pressure vessel.

The "oxygen balance in the pressure vessel" is an over-and-short amount (g) of oxygen needed for changing all of the explosive into gases such as carbon dioxide gas, steam, and nitrogen gas when 100 g of an explosive device including not only the explosive itself but also a chemical agent and others present in the pressure vessel is blasted. The state when the "oxygen balance in the pressure vessel is positive" means a state in which there are oxygen atoms enclosed in the sealed pressure vessel before blasting in an amount sufficient or more for converting the explosive into gases such as carbon dioxide gas, steam, and nitrogen gas by blasting. In the present invention, the oxygen balance is kept positive, and preferably, for example, approximately 20 g or more.

In addition, the particular amount of oxygen is not particularly limited, if the number of oxygen atoms is more than a particular value, and the oxygen may be contained, for example, as a molecule such as oxygen gas or ozone or as a compounds such as sodium peroxide or magnesium peroxide. That is, the oxygen atom is not particularly limited in its form of presence.

The state "under vacuum" means a almost vacuum state obtained by aspirating the vessel with a vacuum pump, and specifically, a state at approximately 60 mm Hg (8.0 KPa) or less. The vessel under the vacuum may contain gases such as air, nitrogen gas, oxygen gas, argon gas, helium gas, and carbon dioxide. In the present specification, an almost vacuum state is also included in the vacuum state.

In addition, the capacity of the "pressure vessel" is not particularly limited, if it is larger than the volume, as estimated at normal temperature and atmospheric pressure, of the gases generated by blasting of the explosive device. For example, the capacity is preferably larger by 30% or more than the volume of the generated gases, as estimated at normal temperature and atmospheric pressure. Accordingly, the "pressure in the pressure vessel after blasting" is not particularly limited, if it is lower than the pressure outside the pressure vessel, but preferably approximately 530 mm Hg (70.7 KPa) to 759 mm Hg (101.2 KPa).

The "blasting" means an operation to blast an explosive device by exploding an explosive agent in the explosive device, and such a blasting method is already known and is not particularly limited, and examples thereof include a method of igniting an explosive device by using an ignition device.

According to the method, by making the oxygen balance of the entire explosive device containing the explosive agent positive, it is possible to convert the carbon in the explosive device into carbon dioxide or carbon monooxide gas and prevent generation of soot in the pressure vessel after blasting, and consequently, to make decontamination of the pressure vessel easier and improve the efficiency of blasting operation. In addition, the combustion period of the chemical agent during blasting is elongated, because there is oxygen in an amount sufficient for combustion of the explosive in the pressure vessel before blasting, and the oxygen is consumed gradually only in an amount needed for combustion. Thus, for example, with sulfur mustard, its carbon chain is oxidized more smoothly, and the decomposition efficiency of the chemical agent increases. In addition, the pressure inside the pressure vessel is kept lower (negative) than atmospheric pressure even after blasting. Thus, it is possible to prevent leakage of the chemical agent from the pressure vessel.

Part or all of the exterior of the pressure vessel may be covered for improvement in safety and acoustic insulation during blasting, and the pressure outside the pressure vessel may be kept at a pressure not lower than atmospheric pressure. The pressure outside the pressure vessel is a value decided relatively to the pressure inside the vessel, and is arbitrary if it is not lower than the pressure inside the vessel.

The blasting method according to the invention is also not particularly limited, but preferably, the particular amount of oxygen is supplied, for example, as oxygen gas. In this way, it is possible to adjust the oxygen balance of the explosive present in the vessel and the pressure inside the vessel after blasting most easily, and also to reduce the processing cost.

It is also favorable to supply part or all of the particular amount of oxygen as an oxygen-containing alkali metal or alkali-earth metal compound. The oxygen-containing alkali metal or alkali-earth metal compound is more preferably an alkali metal peroxide compound or an alkali-earth metal peroxide compound. Examples of the alkali metal peroxide compounds include sodium peroxide, lithium peroxide, rubidium peroxide, cesium peroxide, and the like. Examples of the alkali-earth metal peroxide compounds include magnesium peroxide, barium peroxide, and the like.

In this way, oxygen atoms constituting the oxygen-containing alkali metal or alkali-earth metal compound are released in the pressure vessel during blasting, and supplied as the oxygen needed for combustion of the explosive device, giving an effect similar to that when oxygen gas is enclosed in the pressure vessel. Further, for example when sulfur mustard, lewisite, or the like is used, the alkali metal or alkali-earth metal atom contained in the oxygen-containing alkali metal or alkali-earth metal compound detoxifies the chemical agent, while the alkali metal atom contained in the oxygen-containing alkali metal or alkali-earth metal compound binds to the chlorine atom in the chemical agent, forming an inorganic chlorine compound.

Oxygen gas and an oxygen-containing alkali metal compound or an oxygen-containing alkali-earth metal compound may be used in combination as the source for supplying the particular amount of oxygen.

In the blasting method according to the invention, the particular amount of oxygen is preferably an amount of oxygen gas at which the oxygen gas pressure, as calculated as oxygen gas, becomes equivalent to 15% to 30% of the atmospheric pressure at normal temperature.

The phrase "as calculated as oxygen gas" assumes that all of the particular amount of oxygen atoms are present as oxygen gas (oxygen molecules), and the "oxygen gas pressure equivalent to 15% to 30% of atmospheric pressure" means an oxygen gas pressure of 114 mm Hg (15.2 KPa) to 228 mm Hg (30.4 KPa).

By enclosing oxygen atoms in the number equivalent to a pressure, as calculated as oxygen gas, of 15% to 30% of atmospheric pressure at normal temperature, it becomes possible to prevent generation of soot after blasting and keep the pressure in the pressure vessel after blasting lower (negative) than atmospheric pressure.

BEST MODE FOR CARRYING OUT THE INVENTION

Hereinafter, the preferred embodiments of carrying out the blasting method according to the invention will be described with reference to drawings.

Figure 2:
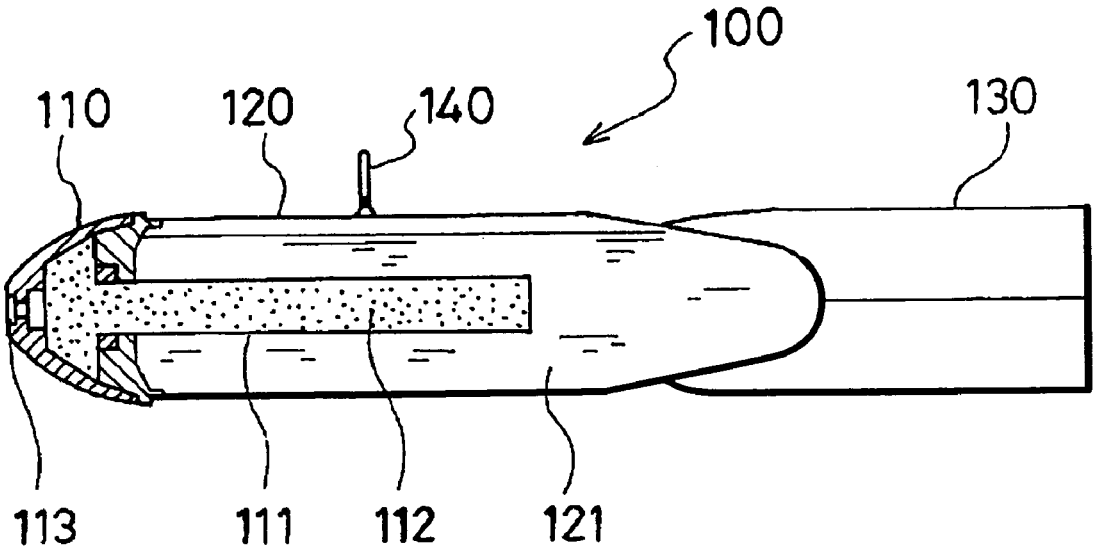
FIG. 2 is a schematic sectional view illustrating the configuration of a chemical bomb.

First, a chemical bomb, one of chemical weapons, will be described as an example of the explosive device to be blasted in the blasting method in the present embodiment with reference to FIG. 2. FIG. 2 is a schematic sectional view illustrating the configuration of a chemical bomb.

As shown in FIG. 2, the chemical bomb (explosive device) 100 has a nose 110, a burster cylinder 111, bomb shell 120, and an attitude-controlling blade 130. The burster cylinder 111 contains a burster (explosive) 112. The nose 110 has a fuse 113 for bursting the burster 112 contained in the burster cylinder 111. The bomb shell 120 is connected to the nose 110 while containing the burster cylinder 111, and a liquid chemical agent 121 is filled therein. The attitude-controlling blade 130 is placed at the side opposite to the nose 110 of bomb shell 120, and controls the attitude of the chemical bomb 100 when dropped. A hoist ring 140 for connection of the chemical bomb 100 to be loaded onto an airplane is placed on the top of the bomb shell 120.

The explosive device 100 processed in the present invention is all or part of a chemical bomb containing at least an explosive 112 and a chemical agent 121.

Figure 3:
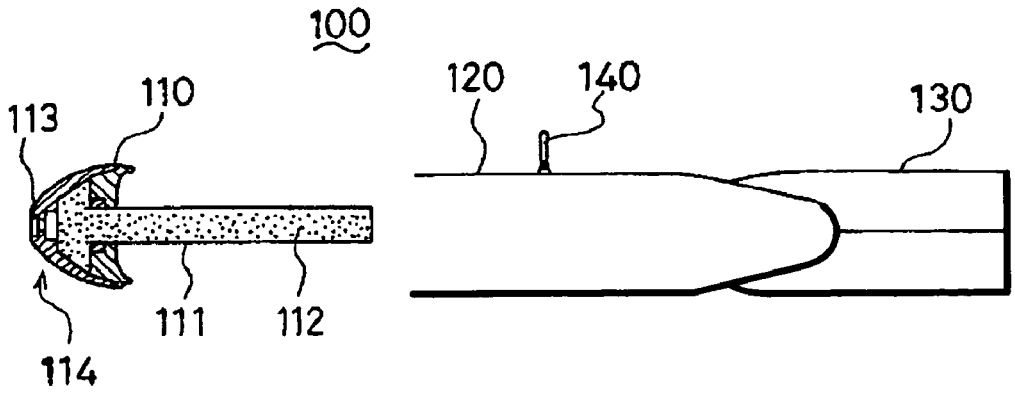
FIG. 3 is a schematic sectional view illustrating the configuration of a burster unit.

The explosive device is not limited to the chemical bomb 100 in which a chemical agent 121 is filled as described above, and the method is also applicable to an explosive device after the chemical bomb is disassembled when only the burster unit is blasted in the pressure vessel. For example, as shown in FIG. 3, it is also applicable to the case where the nose 110 and burster cylinder 111 (burster unit 114) of chemical bomb 100 are blasted after the bomb shell 120 are separated and the chemical agent removed. In such a case, the nose 110 and burster cylinder 111 of chemical bomb 100 often have deposits of the solidified chemical agent adhered thereto, and the present invention is thus effective.

Examples of the applicable explosives include military explosives such as TNT, picric acid, RDX, and PETN. Examples of the applicable chemical agents include erosive agents such as sulfur mustard and lewisite, sneezing agents such as DC and DA, phosgene, sarin, hydrocyanic acid, and the like.

The combination of the explosive and the chemical agent is not particularly limited, but, for example, combinations of TNT and sulfur mustard, and TNT and lewisite, are preferable, because it is possible to detoxify the chemical agent by blasting.

Figure 1:
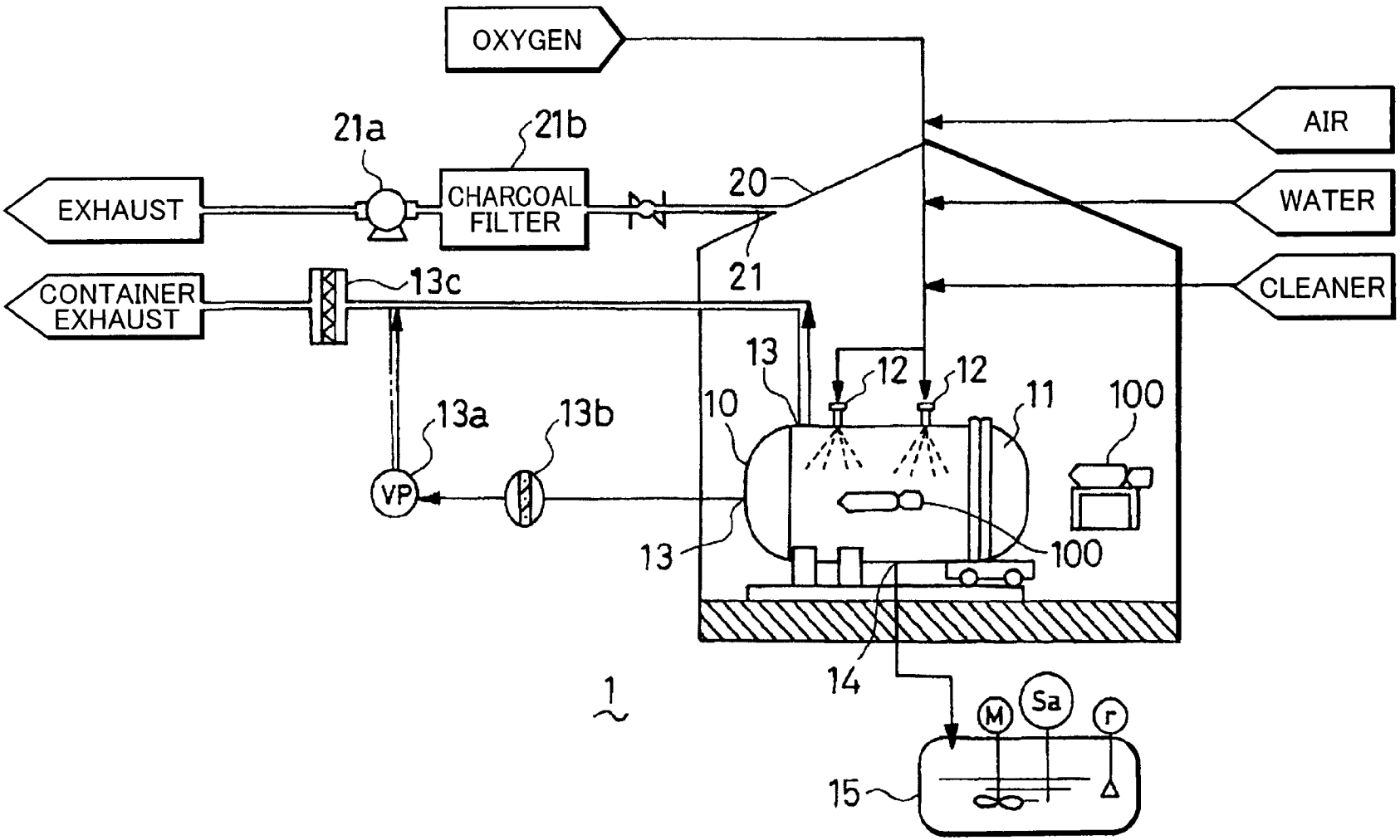
FIG. 1 is a schematic sectional view illustrating the configuration of a blasting chamber.

Hereinafter, an outdoor blasting facility will be described as an example of the facility for blasting explosive devices such as chemical bomb 100 described above with reference to FIG. 1. FIG. 1 is a schematic sectional view illustrating the configuration of a blasting facility.

As shown in FIG. 1, the blasting facility 1 includes a blasting chamber (pressure vessel) 10 and a chamber tent 20 containing the blasting chamber 10 inside.

The blasting chamber 10 is an explosion-proof pressure vessel made, for example, of steel, and is made rigid enough to withstand the blast pressure during blasting of the explosive device such as chemical bomb 100 inside. In addition, the blasting chamber 10 has a cylinder not shown in the Figure inside, which fixes the explosive device such as chemical bomb 100 to be blasted. The blasting chamber 10 has a removable pressure-proof lid 11 on one side wall. The pressure-proof lid 11 is configured to let the transported explosive device such as chemical bomb 100 go inside and make it connected to the cylinder not shown in the Figure as it is separated, and, on the other hand, to allow blasting of the explosive device such as chemical bomb 100 after it is connected and closed. The capacity of the blasting chamber 10 is sufficiently larger than the volume, as estimated at normal temperature and atmospheric pressure, of the gases generated by blasting of the explosive. The capacity is preferably at least more than 130% of the maximum volume of the gaseous, liquid or solid compounds possibly generated by blasting of the explosive device.

Multiple injection ports 12 are formed on the top of the blasting chamber 10. The injection ports 12 are made for injection of oxygen into the blasting chamber 10 before blasting and for injection of air, water, cleaner, and the like into the blasting chamber 10 during decontamination operation after blasting. In addition, exhaust vents 13 are formed on the top of the blasting chamber 10 and on the side wall opposite to the pressure-proof lid 11. The exhaust vents 13 are configured to make the vessel under a reduced-pressure or vacuum state by ventilating air from inside the pressure vessel 10 through a filter 13*b* by using a vacuum pump 13*a* before blasting and to ventilate the vessel exhaust air such as vessel vent from inside the blasting chamber 10 through a filter 13*c* after blasting. In addition, a drainage port 14 is formed at the bottom of the blasting chamber 10. The drainage port 14 is configured to discharge the wastewater out of the processing tank 15 after decontamination operation.

There is an ignition device not shown in the Figure placed outside the blasting chamber 10 for ignition of the explosive device such as chemical bomb 100 fixed in the blasting chamber 10, which allows blasting by remote control.

The chamber tent 20 is a tent (building) made of steel, concrete, or the like, which is made rigid enough to withstand the blast pressure even when the explosive device such as chemical bomb 100 explodes, breaking the blasting chamber 10. The chamber tent 20 has a pressure-proof lid not shown in the Figure, and is configured to allow installation of the explosive device such as chemical bomb 100 in the blasting chamber 10 while the pressure-proof lid is opened. The chamber tent 20 also has an exhaust vent 21 for ventilation of the exhaust air from inside the chamber tent 20 through a filter 21*b*, for example containing activated carbon, by using a blower 21*a*.

In this manner, the blasting facility is a facility 1 that has at least a pressure vessel 10.

As described above, the blasting facility is not limited to the outdoor blasting facility 1 having a pressure vessel 10, and may be an underground blasting facility that blasts an explosive device in an underground tightly sealed pressure vessel or the like.

The method of blasting the chemical bomb 100 above in the blasting facility 1 described above will be described below.

A transported chemical bomb 100 is placed and sealed in the blasting chamber 10 placed in the chamber tent 20 of blasting facility 1. The blasting chamber 10 is then brought into a reduced-pressure or vacuum state by aspiration of the air therein through the filter 13*b* by using the vacuum pump 13*a* and oxygen is fed through the injection port 12 and enclosed in the blasting chamber 10. The reduced-pressure or vacuum state is a state at 60 mm Hg (8.0 KPa) or less and preferably 50 mm Hg (6.7 KPa) or less.

Alternatively, an oxygen-containing alkali metal or alkali-earth metal compound may be enclosed therein as part or all of the oxygen enclosed in the blasting chamber 10. Favorable examples of the oxygen-containing alkali metal or alkali-earth metal compounds include $Na_2O_2$ (sodium peroxide), $CaO_2$ (calcium peroxide), and the like. When an oxygen-containing compound is enclosed, oxygen atoms contained in the oxygen-containing alkali metal or alkali-earth metal compound are released and supplied into the blasting chamber 10 as the oxygen needed for combustion of the explosive device. Thus, it gives an effect similar to the case where oxygen gas is enclosed in the blasting chamber 10. When an oxygen-containing alkali metal or alkali-earth metal compound is enclosed, the oxygen-containing alkali metal or alkali-earth metal compound is placed together with the chemical bomb 100 in the blasting chamber 10, before the blasting chamber 10 is ventilated into a reduced-pressure or vacuum state.

The amount of the oxygen enclosed is an amount at which the oxygen balance of the chemical bomb 100 containing an explosive 112 is positive before blasting and the pressure in the blasting chamber 10 after blasting is lower (negative) than the pressure outside the blasting chamber 10 (external pressure). It is also preferable to keep the pressure in the blasting chamber 10 negative even when air, water, or the like is injected during decontamination operation after blasting. Specifically, the oxygen gas pressure when oxygen gas is enclosed is preferably 15% to 30% of atmospheric pressure at normal temperature.

Then, the explosive device is blasted, while the chemical bomb 100 is ignited with the ignition device.

The combustion period of chemical agent during blasting is kept longer, because the oxygen balance of the chemical bomb 100 containing an explosive 112 remains positive during blasting by the oxygen supplied from the oxygen gas enclosed in the blasting chamber 10 or the oxygen-containing alkali metal or alkali-earth metal compound enclosed in the blasting chamber 10. In addition, alkali metal atom in the oxygen-containing alkali metal or the alkali-earth metal compound enclosed in the blasting chamber 10 binds to the chlorine atom in the chemical agent 121, forming an inorganic chlorine compound.

After blasting, the pressure in the blasting chamber 10 including that of the gases generated by explosion of the chemical bomb 100 is kept to a pressure negative to external pressure.

After blasting of the chemical bomb 100, the blasting chamber is decontaminated by injection of air, water, cleaner, and others through the injection ports 12, the wastewater is discharged out of the blasting chamber 10 into the processing tank 15, and the vessel exhaust air such as vessel vent, out of the blasting chamber 10 through the exhaust vent 13 and via the filter 13*c*.

The pressure in the blasting chamber 10 can be kept to a pressure negative to external pressure, even when air, water, and others are injected in the decontamination operation.

In this manner, according to the blasting method in this embodiment, it is possible to convert carbon in the explosive device into carbon dioxide or carbon monooxide gas and prevent generation of soot by making the oxygen balance in the blasting chamber 10 containing the chemical bomb 100 positive. It is thus possible to make the decontamination of blasting chamber 10 simpler and improve the efficiency of blasting operation.

It is also possible to elongate the combustion period of chemical agent during blasting, because oxygen needed for combustion of the explosive is supplied into the blasting chamber 10. Thus, the chemical agent 121 filled in the chemical bomb 100 is oxidized and the decomposition efficiency of the chemical agent 121 increases.

Further, the pressure in the blasting chamber 10 is kept to a pressure negative to external pressure even after blasting. It is thus possible to prevent leakage of the chemical agent 121 out of the blasting chamber 10.

In addition, the alkali metal atom contained in the oxygen-containing alkali metal or alkali-earth metal compound enclosed in the blasting chamber 10 reacts with the chlorine atom in the chemical agent 121, forming an inorganic chlorine compound. It is thus possible to detoxify the chemical agent 121.

EXAMPLES

Hereinafter, the present invention will be described specifically with reference to Examples, but it should be understood that the present invention is not limited to these Examples.

Example 1

In this Example, 100 g of TNT, which is commonly used as a burster for shell or bomb, was blasted in a pressure vessel having a capacity of 500 L installed at normal temperature under atmospheric pressure, when the pressure vessel is in a vacuum state and when the pressure vessel is evacuated and then oxygen gas is supplied to a pressure of 20% of atmospheric pressure; and the changes in the pressure inside the pressure vessel and the amounts of soot generated are compared. The results are summarized below in Table 1.

TABLE 1

| AMOUNTS OF EXPLOSIVE AND INTRODUCED OXYGEN GAS | | PRESSURE AS OXYGEN GAS | INITIAL PRESSURE | PRESSURE AFTER BLASTING | AMOUNT OF SOOT GENERATED |
|---|---|---|---|---|---|
| TNT | 100 g | 0% | 48 mmHg | 505 mmHg | 5 g |
| TNT | 100 g | 20% | 153 mmHg | 590 mmHg | 0 g |
| OXYGEN GAS | 20% | | | | |

As shown in Table 1, 5 g of soot was generated out of 100 g of TNT when the TNT is blasted in a pressure vessel that was previously aspirated into a vacuum state at 48 mm Hg (6.4 KPa). In addition, the initial pressure in the pressure vessel was 48 mm Hg (6.4 KPa), while the pressure after blasting was 505 mm Hg (67.3 KPa).

In contrast, no soot was generated when the pressure vessel was evacuated and supplied with oxygen gas to a pressure of 20% of atmospheric pressure. The initial pressure in the pressure vessel was 153 mm Hg (20.4 KPa) while the pressure after blasting was 590 mm Hg (78.7 KPa).

As apparent from Example 1 above, when blasting was performed in a pressure vessel previously evacuated and supplied with oxygen gas to a pressure of 20% of atmospheric pressure, soot generation during blasting was prevented and the pressure in the pressure vessel after blasting was kept to a pressure negative to external pressure.

Example 2

In this Example, 100 g of an explosive (containing 45 g of TNT and 55 g of sulfur mustard) was blasted in a pressure vessel having a capacity of 500 L installed at normal temperature under atmospheric pressure, when the pressure vessel is in a vacuum state and when the pressure vessel is evacuated and then oxygen gas is supplied to a pressure of 20% of atmospheric pressure; and the changes in the pressure inside the pressure vessel and the amounts of soot generated are compared. The results are summarized below in Table 2.

TABLE 2

| AMOUNTS OF EXPLOSIVE AND INTRODUCED OXYGEN GAS | | PRESSURE AS OXYGEN GAS | INITIAL PRESSURE | PRESSURE AFTER BLASTING | AMOUNT OF SOOT GENERATED | AMOUNT OF RESIDUAL SULFUR MUSTARD |
|---|---|---|---|---|---|---|
| TNT | 45 g | 0% | 48 mmHg | 227 mmHg | 8 g | 0.01 g |
| SULFUR MUSTARD | 55 g | | | | | |
| TNT | 45 g | 20% | 153 mmHg | 266 mmHg | 0 g | 0 g |
| SULFUR MUSTARD | 55 g | | | | | |
| OXYGEN GAS | 20% | | | | | |

As shown in Table 2, 8 g of soot was generated out of 100 g of the explosive when the explosive was blasted in a pressure vessel, which was previously aspirated into an almost vacuum state at 48 mm Hg (6.4 KPa), and there remained 0.01 g of undetoxified sulfur mustard. The initial pressure in the pressure vessel was 48 mm Hg (6.4 KPa), while the pressure after blasting was 227 mm Hg (30.3 KPa).

In contrast, there was no soot generated and no residual sulfur mustard when the pressure vessel was evacuated and supplied with oxygen gas to a pressure of 20% of atmospheric pressure. The initial pressure in the pressure vessel was 153 mm Hg (20.4 KPa), while the pressure after blasting was 266 mm Hg (35.5 Pa).

As apparent from Example 2 above, when blasting was performed in a pressure vessel previously evacuated and supplied with oxygen gas to a pressure of 20% of atmospheric pressure, no soot was generated and the chemical agent was decomposed during blasting, and the pressure in the pressure vessel after blasting was kept to a pressure negative to external pressure.

The invention claimed is:

1. A blasting method of blasting an explosive device at least containing an explosive and a chemical agent and being placed in a sealed pressure vessel, comprising:

evacuating the pressure vessel into a reduced-pressure or vacuum state;

feeding and enclosing, before blasting, an amount of oxygen in the evacuated pressure vessel which is equal to or more than an amount sufficient (1) to provide a positive oxygen balance in the pressure vessel for blasting and (2) to provide the pressure in the pressure vessel after blasting as lower than a pressure outside the pressure vessel; and blasting the explosive device therein.

2. The blasting method according to claim 1, wherein the particular amount of oxygen is supplied as oxygen gas.

3. The blasting method according to claim 1, wherein part or all of the amount of oxygen is supplied from an alkali metal peroxide compound or an alkali-earth metal peroxide compound.

4. The blasting method according to claim 1, wherein the particular amount of oxygen is an amount of oxygen gas at which the oxygen gas pressure, as calculated as oxygen gas, becomes equivalent to 15% to 30% of the atmospheric pressure at normal temperature.

5. The blasting method according to claim 1, further comprising: cleaning the pressure vessel with a decontaminating agent after the blasting step, while keeping the pressure in the pressure vessel negative.

6. The blasting method according to claim 1, wherein said explosive device is a chemical weapon.

7. A blasting method of blasting an explosive device at least containing an explosive and a chemical agent and being placed in a sealed pressure vessel, comprising:

evacuating the pressure vessel into a reduced-pressure or vacuum state;

feeding and enclosing, before blasting, an amount of oxygen in the evacuated pressure vessel which is equal to or more than an amount sufficient (1) to convert the explosive and the chemical agent into gases by blasting and (2) to provide the pressure in the pressure vessel after blasting as lower than a pressure outside the pressure vessel; and blasting the explosive device therein.

8. The blasting method according to claim 7, wherein the particular amount of oxygen is supplied as oxygen gas.

9. The blasting method according to claim 7, wherein part or all of the amount of oxygen is supplied from an alkali metal peroxide compound or an alkali-earth metal peroxide compound.

10. The blasting method according to claim 7, wherein the particular amount of oxygen is an amount of oxygen gas at which the oxygen gas pressure, as calculated as oxygen gas, becomes equivalent to 15% to 30% of the atmospheric pressure at normal temperature.

11. The blasting method according to claim 7, further comprising: cleaning the pressure vessel with a decontaminating agent after the blasting step, while keeping the pressure in the pressure vessel negative.

12. The blasting method according to claim 7, wherein said explosive device is a chemical weapon.

* * * * *